United States Patent [19]

Yamada et al.

[11] 4,422,873

[45] Dec. 27, 1983

[54] BLOWING METHOD IN A TOP AND BOTTOM BLOWING CONVERTER

[75] Inventors: Hirosuke Yamada; Hisashi Omori, both of Kurashiki, Japan

[73] Assignee: Kawasaki Steel Corporation, Kobe, Japan

[21] Appl. No.: 380,667

[22] PCT Filed: Aug. 31, 1981

[86] PCT No.: PCT/JP81/00205

§ 371 Date: Apr. 30, 1982

§ 102(e) Date: Apr. 30, 1982

[87] PCT Pub. No.: WO82/00835

PCT Pub. Date: Mar. 18, 1982

[30] Foreign Application Priority Data

Aug. 30, 1980 [JP] Japan ..... 55-119008

[51] Int. Cl.[3] ..... C21C 5/34; C21C 5/36

[52] U.S. Cl. ..... 75/52; 75/59; 75/60

[58] Field of Search ..... 75/52, 53, 60, 59

[56] References Cited

U.S. PATENT DOCUMENTS 3,771,998 11/1973 Knuppl ..... 75/52

*Primary Examiner*—Peter D. Rosenberg

*Attorney, Agent, or Firm*—Balogh, Osann, Kramer, Dvorak, Genova & Traub

[57] ABSTRACT

The present invention belongs to a technical field in the oxygen steel making, more particularly in the steel making by blowing oxygen into a converter from its top and bottom. The total amount of oxygen to be blown into a top and bottom blowing converter is substantially the same as that of oxygen to be blown into a bottom blowing converter, but a part of the total amount of the oxygen is blown into the converter from its top. Therefore, the injection capacity for lime powder is necessarily decreased corresponding to the decrease of the blow rate of the bottom blown oxygen, and the decrease of the injection capacity causes the initial stage blowing up, being generated often in the case where blowing of lime powder is not carried out in the bottom blowing. The present invention aims to solve the above described drawback of the initial stage blowing up in the conventional top and bottom blowing technic and at the same time to improve the dephosphorization effect at the final stage of the blowing by blowing lime powder into a top and bottom blowing converter according to such a blowing pattern that the lime powder is blown in an amount satisfying a condition of $(CaO/SiO_2)^{-1} \times SiO_2$ (kg/t)$\leqq$13 (kg/t) at the initial stage of the blowing and further is blown in an amount of 3 kg/t at the final stage of the blowing.

The use is a production of steel mainly from molten pig iron.

3 Claims, 8 Drawing Figures

BLOWING METHOD IN A TOP AND BOTTOM BLOWING CONVERTER

TECHNICAL FIELD

The present invention relates to a blowing method in a converter, especially in a top and bottom blowing converter among steel-making furnaces, and more particularly relates to a blowing method capable of preventing the blowing up of slag and metal, which blowing up is apt to occur at the initial stage of blowing of molten steel in a converter, and further capable of removing advantageously phosphorus from the molten steel at the same time with the prevention of the blowing up of molten steel.

BACKGROUND ART

There has been often experienced the blowing up of slag and metal at the initial stage of blowing of molten steel in a bottom blowing converter. The initial stage blowing up is a phenomenon, in which several 10 tons of slag and metal is bumped from the feed opening of a converter near the time of completion of desilication during the course of blowing in a bottom blowing converter. Particularly, the blowing up phenomenon has often occurred in case of the operation of a bottom blowing converter without lime powder injection. Therefore, it is eagerly demanded to prevent the initial stage blowing up in a stable operation of a top and bottom blowing converter, of which capacity of lime powder injection for the total amount of oxygen is considerably poorer than the bottom blowing converter.

While, it is commonly known that calcined lime is used in order to promote the dephosphorization of molten steel. It can be expected the same effect in the blowing of calcined fine lime powder into a top and bottom blowing converter through its bottom tuyere and in the blowing of lump-shaped lime into a top and bottom blowing converter through its feed opening similarly to the case of conventional top blowing converter. However, the reaction velocity in the top and bottom blowing converter is increased due to oxygen blown into the bottom of the converter and therefore there is a risk of initial stage blowing up before and after the completion of the above described desiliconization, and it is not advantageous to use lump-shaped lime.

Although the above described blowing of lime powder can decrease the above described risk, the risk can not be completely obviated. Therefore, a method for carrying out a stable operation in a top and bottom blowing converter is required.

DISCLOSURE OF THE INVENTION

It is an object of the present invention to provide a method for preventing advantageously the initial stage blowing up, which would occur at the initial stage of blowing of a molten steel in a top and bottom blowing converter, in order to carry out a stable operation in the converter.

Another object of the present invention is to provide a method capable of removing phosphorus from the molten steel as well as the prevention of the initial stage blowing up.

The inventors have investigated a blowing pattern of lime powder during the blowing, and found out that, when the amount of lime powder to be supplied into a top and bottom blowing converter is controlled depending upon the basicity of slag and the amount of $SiO_2$ formed in the converter at the initial stage of the blowing, which initial stage is from the beginning of the blowing to the completion of desiliconization, the above described objects can be advantageously attained.

The first aspect of the present invention lies in a method of blowing a molten steel in a top and bottom blowing converter, comprising blowing lime powder into the converter through tuyeres arranged on the bottom thereof according to such a blowing pattern at the initial stage of the blowing, which initial stage is from the beginning of the blowing to the completion of desiliconization, that the lime powder is blown into the converter in an amount satisfying the following formula $$(CaO/SiO_2)^{-1} \times (SiO_2)(kg/t) \leqq 13(kg/t)$$

depending upon the basicity of slag and the amount of $SiO_2$ formed in the converter during the initial stage of the blowing.

The second aspect of the present invention lies in a method, wherein lime powder is blown into the converter according to such a blowing pattern, in addition to the blowing pattern defined in the first aspect, that the lime powder is blown into the converter in an amount of at least 3 kg/t at the final stage of the blowing, which final stage is from the time, wherein the carbon concentration in the molten steel has decreased to 0.50% or less, to the blow end.

When the blowing pattern of lime powder is specified as described above, the development of initial stage blowing up in the converter can be properly prevented to enhance the stability of the blowing operation and to control easily the blowing operation in the first aspect of the present invention; and further the dephosphorization can be effectively promoted to improve the quality of the steel product in the second aspect of the present invention as well as the prevention of the initial stage blowing up.

BEST MODE FOR CARRYING OUT THE INVENTION

Figure 1:
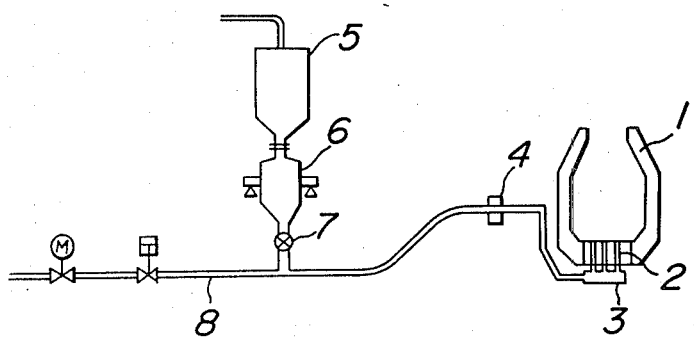
FIG. 1 is a schematic view of a converter installation to be used for carrying out the present invention.

FIG. 1 illustrates schematically an installation for blowing calcined fine lime powder into a top and bottom blowing converter. In FIG. 1, the numeral 1 represents a top and bottom blowing converter (the top blowing lance is not shown in the figure), 2: a tuyere arranged on the bottom of the converter, 3: a distributor arranged on the bottom of the converter, 4: a rotary joint, 5: an intermediate tank for calcined fine lime powder 6: a metering tank, 7: a rotary valve, and 8: a gas supply pipe.

Oxygen or an inert gas is supplied into a molten steel previously charged in a converter 1 through an gas supply pipe together with calcined fine lime powder.

When oxygen is supplied into a molten steel through a tuyere 2 arranged on the bottom of a converter, the reaction velocity of oxygen is higher than that in the case of a top blowing converter, and moreover the supplied gas or CO gas generated by the reaction goes up through the molten steel, and therefore a slag formed on the surface of the molten steel is apt to be blown up at the initial stage of blowing. This blowing up phenomenon can be effectively prevented by using a proper blowing pattern of calcined fine lime powder.

The inventors measured the vibration caused in the lance arranged on a top and bottom blowing converter of 250 ton capacity, whereby the intensity of the vibration was detected and the mechanism for developing the blowing up phenomenon was specifically investigated.

Figure 2:
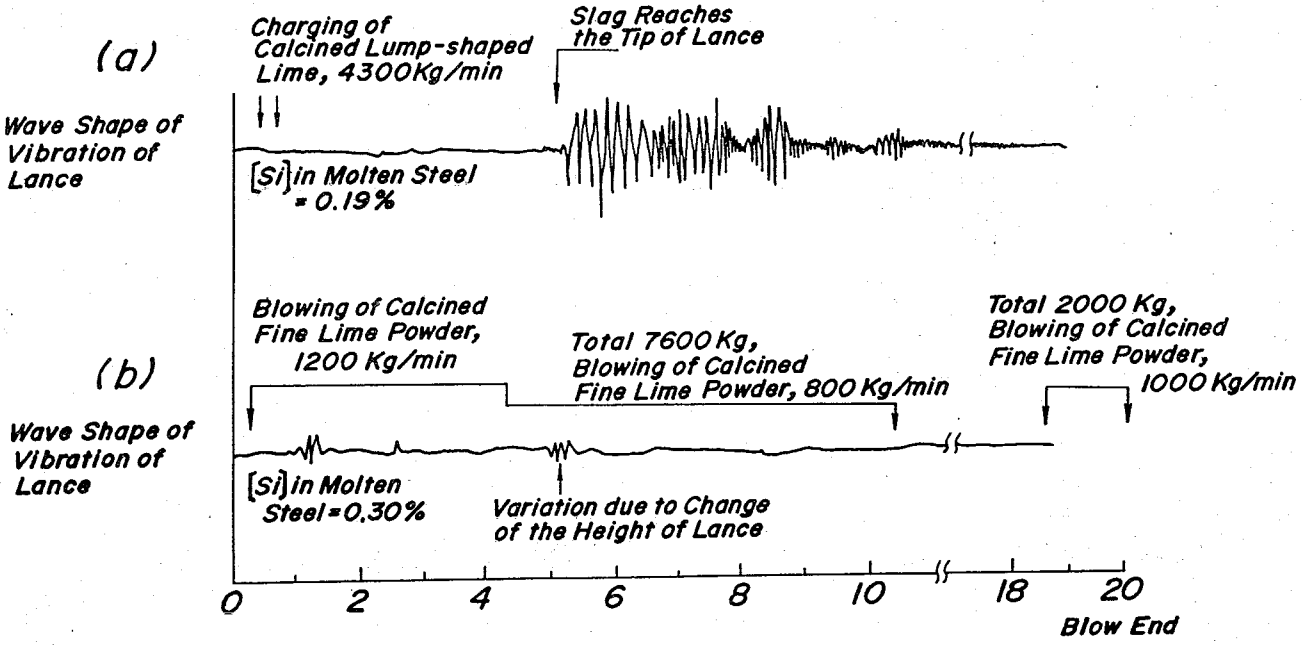
FIG. 2 illustrates the difference between the wave shapes of vibrations of lances due to the difference between the conditions under which calcined limes are added to molten steel, wherein curve (a) illustrates the wave shape in the charge of lump-shaped calcined lime from the top of a converter, and curve (b) illustrates the wave shape in the charge of calcined fine lime powder from the bottom of a converter.

One of the results of the investigation will be explained referring to FIG. 2. Curves (a) and (b) of FIG. 2 are vibration charts caused in an oxygen top blowing lances at the initial stage of blowing in the case where lump-shaped lime was charged into the converter from its top, and in the case where calcined fine lime powder was blown into the converter from its bottom, respectively. The lances were located in the converter in the same height of 1.5 m from the feed opening of the converter in both cases.

The vibration of the lance means that slag has gone up to the height of the lance, and when lump-shaped lime is used, an initial stage blowing up phenomenon appears as illustrated in curve (a) in FIG. 2. On the contrary, when calcined fine lime powder is blown into a converter from the bottom according to a proper blowing pattern, an initial stage blowing up phenomenon does not appear at all as illustrated in curve (b) in FIG. 2.

Figure 3:
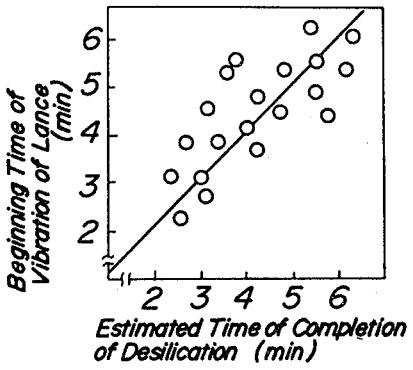
FIG. 3 is a graph illustrating a relation between the desiliconization reaction and the vibration of lance.

The blowing velocity of calcined fine lime powder has undergone various changes, and the condition, under which the initial stage blowing up phenomenon appeared, was investigated by comparing 20 heat levels which caused the phenomenon, with 20 heat levels which did not cause the phenomenon. FIG. 3 shows the result. It can be seen from FIG. 3 that the time, at which the initial stage blowing up phenomenon appears, substantially corresponds to the time, at which the desiliconization is completed, at any of the heat levels.

That is, the generating velocity of CO gas suddenly increases just after the desiliconization has been completed, and in this case it is important whether or not the CO gas can be easily passed through the slag. Accordingly, it is necessary that the slag is kept to a low viscosity at the time of completion of desiliconization. In order to get the low viscosity slag, it is effective to increase rapidly the basicity of the slag.

The reason why the above described initial stage blowing up appears in the heat using lump-shaped lime is that the lump-shaped lime converts slowly into the slag. Accordingly, a satisfactory high basicity can not be obtained before the desiliconization is completed.

Figure 4:
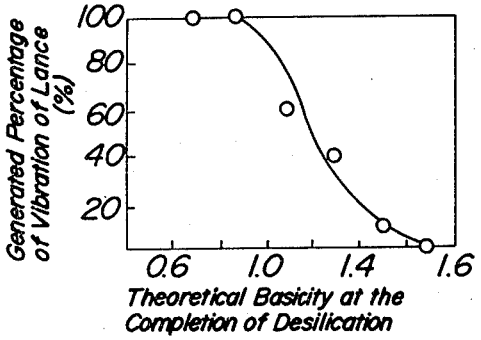
FIG. 4 is a graph illustrating a relation between the theoretical basicity at the time of desiliconization and the vibration of lance.

FIG. 4 illustrates a relation between the theorical basicity at the time of completion of desiliconization and the generation of initial stage blowing up (percentage of generation of lance vibration). It can be seen from FIG. 4 that, when the theoretical basicity of slag exceeds about 1.6, the above described initial stage blowing up does not appear at all. That is, this theoretical basicity of slag suggests directly the change of physical properties, such as viscosity and the like, of the slag, and can be effectively used. The inventors have further found out that whether the initial stage blowing up of slag actually occurs or not is highly influenced by the amount of the slag.

Figure 5:
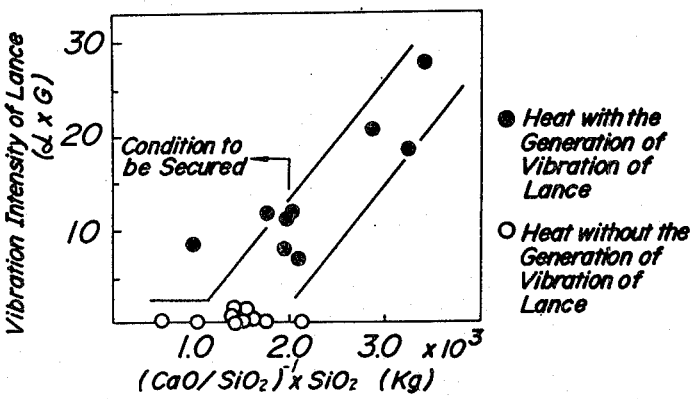
FIG. 5 is a graph illustrating a relation between the slag condition and the vibration of lance.

The inventors have made various trial and error investigations with respect to this point and found out that there is an intimate correlation between the product (theoretical value) of the reciprocal of the basicity of slag and the amount $SiO_2$ formed at the initial stage of blowing and the vibration intensity of lance. FIG. 5 illustrates this relation.

FIG. 5 shows the above described product in its abscissa and the vibration intensity of lance in its ordinate. It is clear from FIG. 5 that the vibration intensity of lance increases corresponding to the increase of the product of the reciprocal of basicity and the amount of $SiO_2$.

It can be seen from FIG. 5 that the lance begins to vibrate when $(CaO/SiO_2)^{-1}\times SiO_2$ (kg) is more than 2,000 (kg), and that slag begins to blow up actually through the feed opening of a converter when $(CaO/SiO_2)^{-1}\times SiO_2$ (kg) is more than 3,500 (kg) in the practical operation of a converter of 250 ton capacity.

When $(CaO/SiO_2)^{-1}\times SiO_2$ (kg) is less than 3,500 (kg), the above described initial stage blowing up can be prevented. Accordingly, when the above described relation, $(CaO/SiO_2)^{-1}\times SiO_2$ (kg) $<3{,}500$ (kg), is converted into a relation per ton of molten steel and a certain amount of safety factor is taken into consideration, the initial stage blowing up can be prevented by such a blowing pattern for calcined fine lime powder, which satisfies the following formula at the time of completion of desiliconization.

$$(CaO/SiO_2)^{-1}\times(SiO_2)\ (kg/t)\leqq 13\ (kg/t)$$

When the concentration (%) of Si in a molten steel is represented by [Si], the blow rate of bottom blown oxygen is represented by Q ($Nm^3/t\cdot min$), the oxygen efficiency in desiliconization during the desiliconization stage is represented by $\eta$, and the time required for completing the desiliconization is represented by T (min), the amount of the resulting $SiO_2$ (kg/t) and the time T can be calculated as follows:

$$SiO_2\ (kg/t)=[Si]\times 10^{-2}\times(60/28)\times 10^{3}=(600/28)\ [Si]\ (kg/t)$$

$$T=10^{3}\times[Si]\times 10^{-2}\times(22.4/28)\div\eta\div Q$$

While, the amount of CaO, which satisfy the condition of $(CaO/SiO_2)^{-1}\times SiO_2\leqq 13$, is given by the formula of Ti $CaO > (SiO_2)^2/13$ (kg) Accordingly, the blow rate U of CaO is calculated as follows.

$$U = CaO/T > 4.42\ [Si] \cdot \eta \cdot Q\ (kg/t \cdot min)$$

In the above formula, when $\eta$ is assumed to be 0.4, 600 $Nm^3$/min of oxygen should be supplied into a 250 t heat size. Therefore, when [Si] is 0.5%, calcined fine lime powder is blown into a converter at a rate of at least 530 kg/min until the desiliconization has been completed.

Then, a blowing of calcined fine lime powder at the final stage of blowing will be explained hereinafter. In general, the blowing of calcined fine lime powder into a converter at the final stage of blowing is effective for dephosphorization when the carbon concentration [C] in a molten steel is 0.5% or less. In this final stage of blowing, it is particularly necessary that the blowing of calcined fine lime powder is carried out under a condition suitable for dephosphorization.

Figure 6:
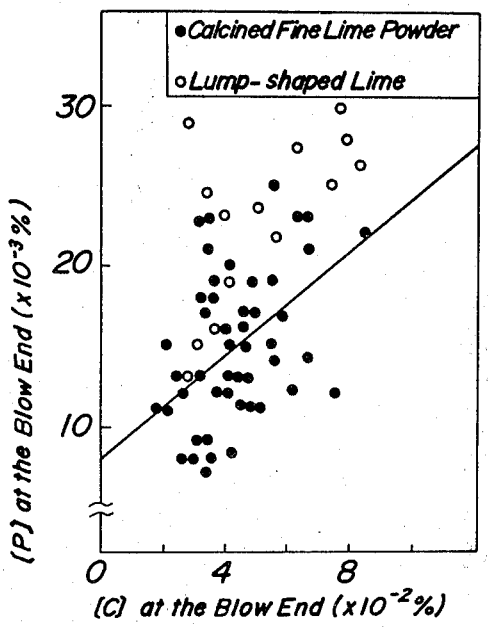
FIG. 6 is a graph illustrating the influence of the difference between lime powder and lump-shaped lime upon the [P] at the blow end.

FIG. 6 illustrates a relation between $CaO/SiO_2$ in the heat which uses lump-shaped lime, and in the heat, which includes a blowing pattern of calcined fine lime powder at the final stage of blowing, and P at the blow end.

It can be seen from FIG. 6 that there is a high correlation between [P] and [C] at the blow end in the heat using calcined fine lime powder.

At the final stage of blowing, calcined fine lime powder must be blown into a molten steel according to such a blowing pattern that at least 3 kg/t of the lime powder is blown until the blow end. The reason is as follows.

The dephosphorization at the final stage of blowing proceeds only when C has decreased to 0.50% or less. However, it takes a very short period of time of only about 1 minute from the time, wherein C has decreased to 0.50%, to the blow end. It has been found out from experience that the amount of calcined fine lime powder to be supplied so as to serve effectively for the dephosphorization in such a short period of time must be at least 3 kg/t.

Figure 7:
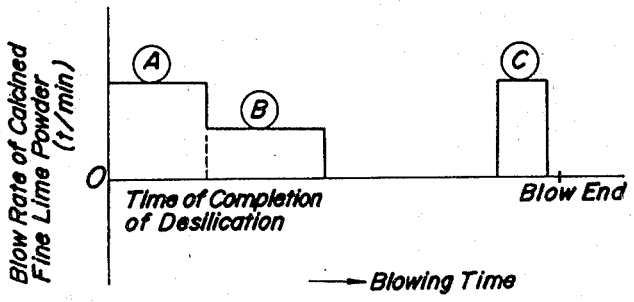
FIG. 7 is a diagrammatical view of the blowing pattern of lime powder according to the present invention.

As described above, an optimum blowing pattern of lime powder in a top and bottom blowing converter consists of the following stages (A), (B) and (C) as illustrated in FIG. 7.

Stage (A): A stage from the beginning of blowing to the completion of desiliconization. Calcined lime is blown into a converter during this stage at such a blow rate that the amount of the calcined powder blown into the molten steel until the completion of desiliconization satisfies a condition of $(CaO/SiO_2)^{-1} \times SiO_2$ (kg/t) $\leqq 13$ (kg/t)

Stage (C): A stage from the time, wherein [C] has decreased to less than 0.50%, to the blow end. Calcined lime is blown into the converter during this stage in order to promote effectively the dephosphorization, at such a blow rate that the blown amount of calcined lime before the termination of blowing is at least 3 kg/t.

Stage (B): An intermediate stage between the above described stages (A) and (C). The remainder of calcined lime, which is obtained by subtracting the blown amounts of calcined lime in stages (A) and (C) from the total amount of calcined lime, is fed to the molten steel. In this stage (B), lump-shaped lime can be supplied into the converter through its feed opening in place of calcined fine lime powder.

An optimum lime powder to be used in the present invention is calcined fine lime powder as described above. As a carrier gas for the lime powder, not only the above described bottom blown oxygen, but also gases substantially inert for molten steel can be used with or without serving as a stirring agent.

The following example is given for the purpose of illustration of this invention.

Figure 8:
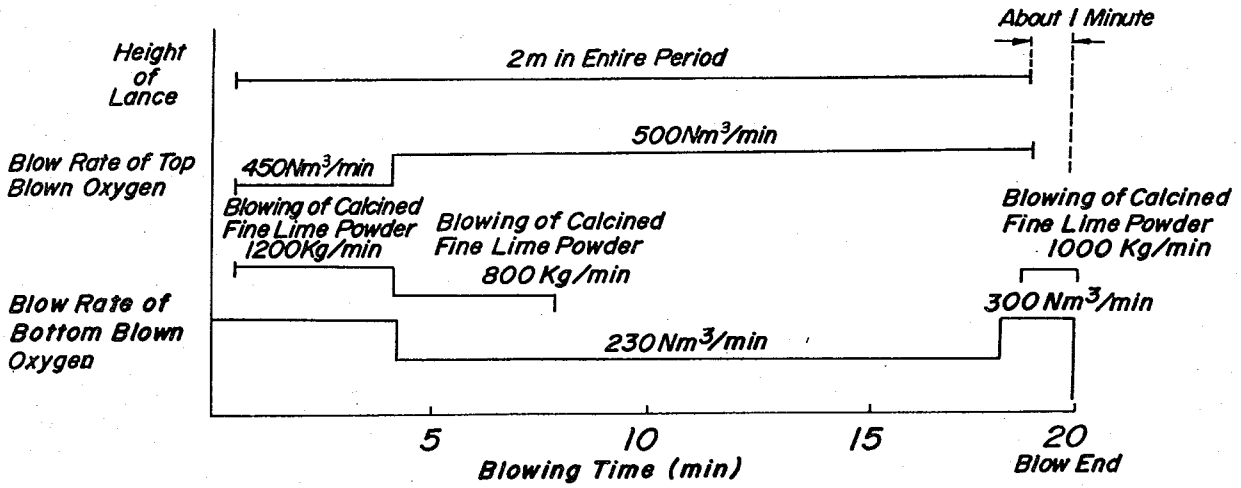
FIG. 8 is a diagrammatical view of a blowing method according to the present invention.

A top and bottom blowing converter of 250 ton capacity was used, and a heat wherein lime powder was blown into the converter from its bottom according to the present invention, was compared with a comparative heat wherein lump-shaped lime was used. In both heats, molten steel having an [Si] concentration of 0.3% was used (refer to FIG. 8).

In both heats, the height of lance was kept to the same height of 2 m. A top blown oxygen was blown at a rate of 450 $Nm^3$/min within 4 minutes at the initial stage of blowing, and then at a rate of 500 $Nm^3$/min. A bottom blown oxygen was blown at a rate of 340 $Nm^3$/min within 4 minutes at the initial stage of blowing, then at a rate of 230 $Nm^3$/min, and further at a rate of 300 $Nm^3$/min within 2 minutes before the blow end. The blowing pattern of calcined fine lime powder according to the present invention is as follows. The lime powder was blown, together with the bottom blown oxygen, at a rate of 1,200 kg/min at the initial stage of blowing, and then at a rate of 800 kg/min for 4 minutes. Since it was forcast that the [C] concentration in the molten steel would be 0.5% before 1.2 minutes of the termination of blowing, the calcined fine lime powder was further blown at a rate of 1,000 kg/min within 1.5 minutes before the blow end (the actual [C] concentration at the time of before 1.5 minutes from the blow end was 0.7%). In this blowing, the total blown amount of calcined fine lime powder was 9,100 kg. In the comparative heat, every 600 kg of lump-shaped lime was fed into the converter from its feed opening by every 0.5 minute in 15 times so as to correspond to the above described amount in total.

When the oxygen efficiency in the desiliconization is assumed to be 0.4% under a molten steel percentage of 0.90%, the completion time of desiliconization is calculated to be $$270 \times 10^3 \times 0.3 \times 10^{-2} \times (22.4/28) \div (450 + 340) \div 0.4 = 2.1\ (min.)$$

The amount of $SiO_2$ formed is calculated to be $$270 \times 10^3 \times 0.3 \times 10^{-2} \times (60/28) = 1{,}736\ (kg)$$

and the amount of Cao used in the above described reaction is calculated to be $$1.2\ (t/min) \times (2.1 - 0.25) = 2{,}220\ (kg).$$

Accordingly, the product of the reciprocal of theoretical basicity of slag and the amounts of $SiO_2$ is calculated to be $$(CaO/SiO_2)^{-1} \times SiO_2\ (kg/t) = (1{,}736/2{,}220) \times (1{,}736/280) = 4.85\ (kg/t).$$

This value of the product satisfy the condition of the present invention. As a result, according to the present invention, a stable blowing operation in a converter was realized without causing any initial stage blowing up until the desiliconization stage had elasped. On the contrary, in the heat using lump-shaped lime, the lance is violently vibrated before and after completion of desiliconization stage, and therefore the operation must be controlled so as not to cause the initial stage blowing up.

Moreover, the heat, wherein the blowing pattern of lime powder at the final stage of blowing was set to the above described pattern, was lower by about 0.003% in the [P] at the blow end than the heat, wherein lump-shaped lime was fed into the converter.

INDUSTRIAL APPLICATION

According to the first aspect of the present invention, wherein lime powder is blown into a top and bottom blowing converter through tuyeres arranged on the bottom thereof according to a specifically limited blowing pattern, a dangerous initial stage blowing up phenomenon, which is apt to occur before and after the time of completion of desilication when lump-shaped lime is charged into a top and bottom blowing converter according to a conventional method, can be surely prevented, and a stable operation of the top and bottom blowing converter can be carried out; and according to the second aspect of the present invention, wherein a blowing pattern of lime powder at the final stage of blowing is further limited in addition to the blowing pattern defined in the first aspect, phosphorus can be effectively removed from molten steel by a stable blowing operation in a dephosphorization percentage remarkably higher than that in the charging of lump-shaped lime, and steel products having a high quality can be obtained.

We claim:

1. A method of blowing a molten steel in a top and bottom blowing converter, comprising blowing lime powder into the converter through tuyeres arranged on the bottom thereof according to such a blowing pattern at the initial stage of the blowing, said initial stage being from the beginning of the blowing to the completion of desiliconization, that the lime powder is blown into the converter in an amount satisfying the following formula $$(CaO/SiO_2)^{-1} \times SiO_2\ (kg/t) \leqq 13\ (kg/t)$$

depending upon the basicity of slag and the amount of $SiO_2$ formed in the converter during the initial stage of the blowing.

2. A method of blowing a molten steel in a top and bottom blowing converter, comprising blowing lime powder into the converter through tuyeres arranged on the bottom thereof according to such a blowing pattern that the lime powder is blown into the converter, at the initial stage of the blowing, said initial stage being from the beginning of the blowing to the completion of desiliconization, in an amount satisfying the following formula $$(CaO/SiO_2)^{-1} \times SiO_2\ (kg/t) \leqq 13\ (kg/t)$$

depending upon the basicity of slag and the amount of $SiO_2$ formed in the converter during the initial stage of the blowing, and further the lime powder is blown into the converter in an amount of at least 3 kg/t at the final stage of the blowing, said final stage being from the time, wherein the carbon concentration in the molten steel has decreased to 0.50% or less, to the blow end.

3. A method according to claim 1 or 2, wherein the blowing velocity U of lime powder at the initial stage of the blowing is defined by a blowing pattern satisfying the following formula, $$U \geqq 4.42\ [Si] \cdot \eta \cdot Q\ (kg/t \cdot min)$$

wherein

[Si]: silicon concentration (%) in the starting molten steel $\eta$: oxygen efficiency (%) in the desiliconization during the disiliconization stage Q: blow rate ($Nm^3/t \cdot min$) of bottom blown oxygen.

* * * * *